US005088468A

United States Patent [19]

Imaeda

[11] Patent Number: 5,088,468

[45] Date of Patent: Feb. 18, 1992

[54] INTERLINKING MECHANISM FOR MULTIPLE CARBURETOR SYSTEM

[75] Inventor: Hirofumi Imaeda, Hamamatsu, Japan

[73] Assignee: Sanshin Kogyo Kabushiki Kaisha, Hamamatsu, Japan

[21] Appl. No.: 472,589

[22] Filed: Jan. 30, 1990

[30] Foreign Application Priority Data

Feb. 2, 1989 [JP] Japan ..... 1-24470

[51] Int. Cl.[5] ..... F02B 13/00

[52] U.S. Cl. ..... 123/583; 261/41.3; 261/23.2

[58] Field of Search ..... 123/583; 261/23.2, 41.2

[56] References Cited

U.S. PATENT DOCUMENTS 2,420,925 5/1947 Wirth ..... 123/583
4,141,940 2/1979 Dye ..... 123/23.2
4,384,559 5/1983 Tchang et al. ..... 123/41.3
4,577,608 3/1986 Du Bois et al. ..... 123/583

*Primary Examiner*—E. Rollins Cross
*Attorney, Agent, or Firm*—Ernest A. Beutler

[57] ABSTRACT

A throttle valve synchronizing arrangement for the induction system of a V type engine wherein the throttle valves associated with each cylinder bank rotate in common vertical planes but wherein these planes are not parallel or collinear with each other and wherein the throttle valve shafts are staggered. The throttle valve of each bank are synchronized with each other by a linkage system and the banks are synchronized with respect to each other by connection to an intermediate shaft that is disposed at a greater angle to the shafts of the throttle valves of the banks than the angle between the throttle valves of the banks.

17 Claims, 4 Drawing Sheets

INTERLINKING MECHANISM FOR MULTIPLE CARBURETOR SYSTEM

BACKGROUND OF THE INVENTION

This invention relates to a synchronizing mechanism for the butterfly valves that control the flow through an induction passage for an internal combustion engine.

In many instances the induction system for a multiple cylinder internal combustion engine includes multiple butterfly type valves that control the flow to the induction system. These may be either throttle valves for a carburetor or fuel injection system or choke valves for a carburetor. In many instances, the disposition of the engine is such that the induction passages and specifically the butterfly valve shafts are not all in a row. For example, with V type engines, it is frequently the practice to position the induction passages so that they extend at an angle to each other. Although the induction passages associated with the individual banks may be aligned, the banks are staggered relative to each other and the induction passages of one bank may not be parallel or aligned with those of the other bank.

Of course, it is desirable to insure that the throttle valves or choke valves all rotate in unison. Furthermore, synchronization of the movement of these valves is obviously essential.

It is, therefore, a principal object of this invention to provide an improved valve arrangement for synchronizing the operation of butterfly valves of the induction passage of an internal combustion engine.

It is a further object of this invention to provide a valve synchronizing arrangement that permits synchronized movement of a plurality of valve that are neither aligned nor parallel to each other.

It is a further object of this invention to provide an improved throttle control for an internal combustion engine having banks of non aligned, non parallel induction passages.

SUMMARY OF THE INVENTION

This invention relates to a valve arrangement for synchronizing the operation of butterfly valves of first and second induction system controls rotatable about non parallel, non coincident axes. An intermediate shaft is rotatable about an axis and carries first and second levers at its opposite ends. Third and fourth levers are affixed for rotation with the first and second induction system butterfly valves and first and second links interconnect the first and third levers and second and fourth levers for synchronizing the movement.

DETAILED DESCRIPTION OF THE PREFERRED EMBODIMENT OF THE INVENTION

Figure 1:
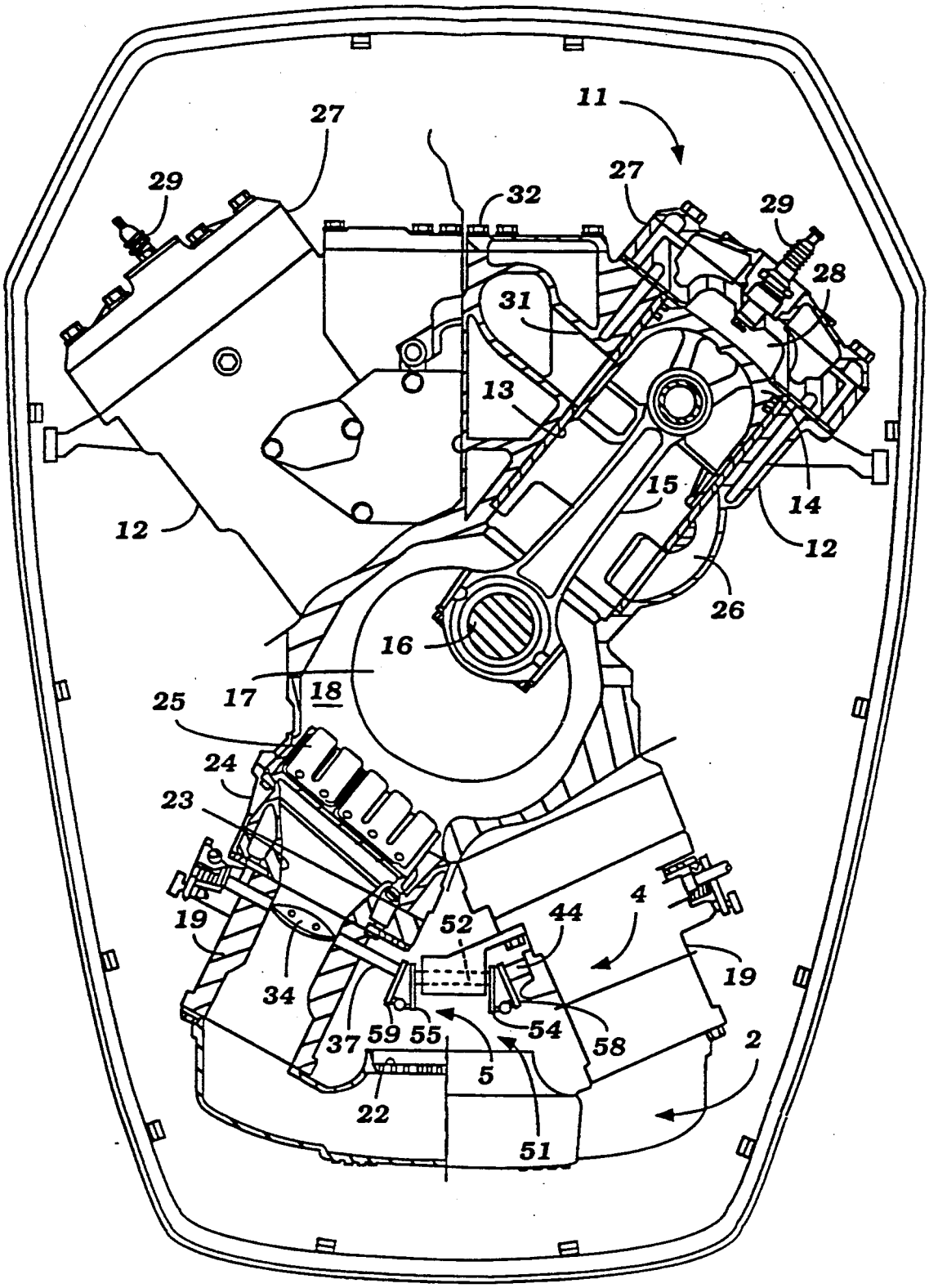
FIG. 1 is a top plan view of an outboard motor constructed in accordance with an embodiment of the invention, with a portion of the protective cowling removed and other portions broken away and shown in section.

Referring first to FIG. 1, a top plan view of an outboard motor having an internal combustion engine with a throttle synchronizing mechanism corresponding to the invention is identified generally by the reference numeral 11. The invention is depicted in conjunction with an outboard motor because outboard motors frequently have cylinder and induction system arrangements which give rise to problems solved by this invention. Since the invention relates primarily to the throttle synchronizing mechanism, only portions of the outboard motor have been shown and only those parts necessary to understand the construction and operation of the invention will be described.

The engine 11 is, in the depicted embodiment, of the V-6 type and is comprised of pairs of angularly disposed cylinder banks 12, each of which has three aligned cylinder bores, only one of which appears in the drawings and which is identified by the reference numeral 13. Pistons 14 reciprocate in each of the cylinder bores 13 and are connected by means of connecting rods 15 to throws 16 of a crankshaft, indicated generally by the reference numeral 17. As is typical with outboard motor practice, the crankshaft 17 rotates about a vertically extending axis.

In the depicted embodiment, the engine 11 is of the two cycle crankcase compression type and, for that reason, individual crankcase chambers 18 associated with each of the pistons 14 and cylinder bores 13 are sealed relative to each other in an appropriate manner.

Figure 2:
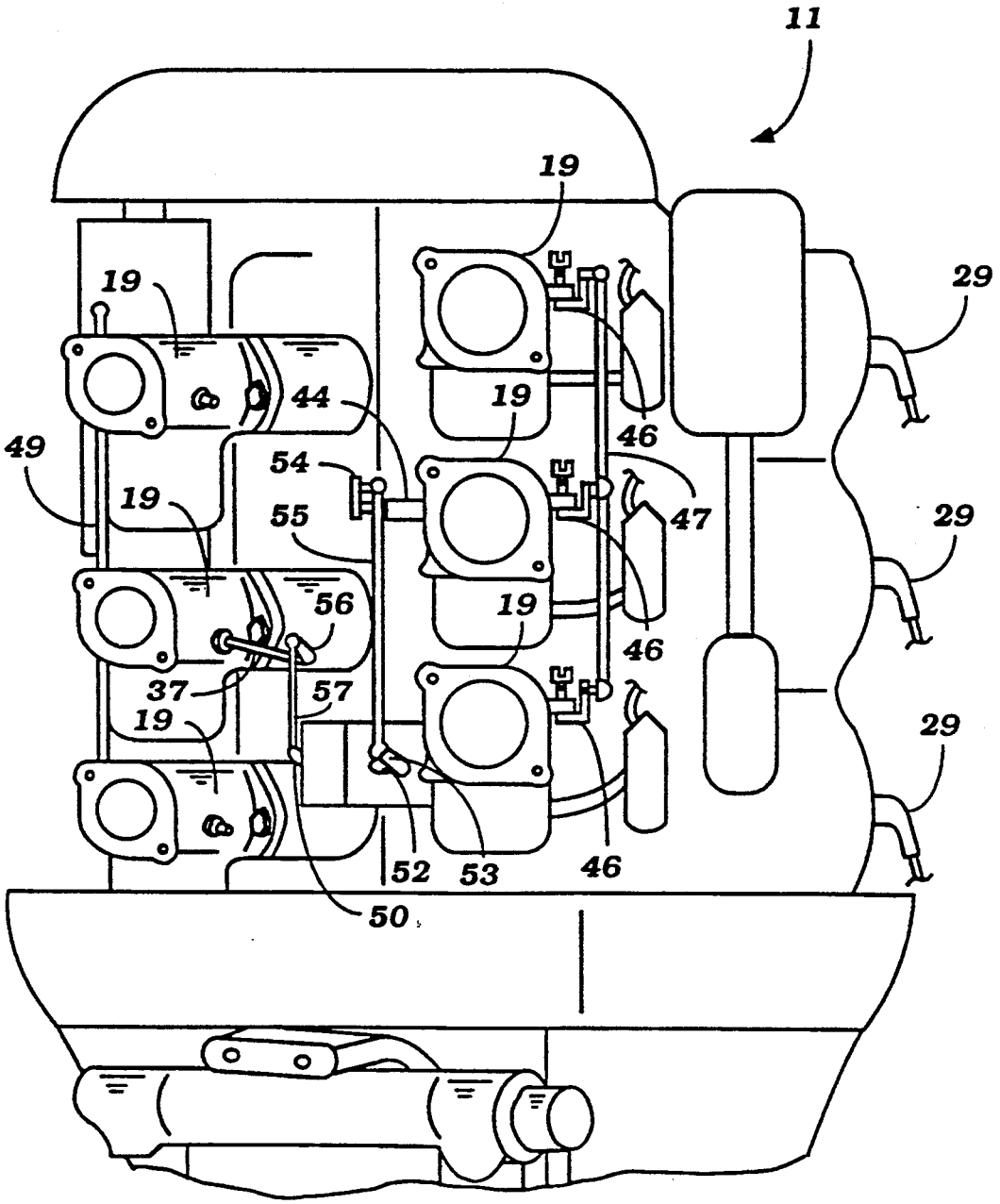
FIG. 2 is an elevational view looking in the direction of the arrow 2 in FIG. 1 with the induction system inlet device removed.

An induction system is provided for supplying at least an air charge to each of the individual crankcase chambers 18. In the illustrated embodiment, this induction system also supplies fuel. Thus there are provided a series of carburetors 19, each associated with a respective one of the cylinder banks 12. As is conventional with V type engine practice, the cylinder banks 12 and 13 are offset relative to each other and, accordingly, the carburetors 19 are offset as may be best seen in FIG. 2. Furthermore, the carburetors 19 associated with each cylinder bank are either aligned with the cylinder bores of the cylinder bank or slightly staggered relative thereto. Such an arrangement provides good induction efficiency while still permitting a compact engine arrangement.

An air inlet device 21 supplies silenced intake air drawn through an inlet screen 22 to the individual carburetors 19. The fuel/air charge then exits through a spacer plate 23 and into the crankcase chambers 18 via a manifold 24 in which reed type check valves 25 are provided for insuring against reverse flow. The charge admitted to the crankcase chambers 18 is compressed and is transferred through scavenge passageways 26 to the area above the pistons 12.

A cylinder head assembly 27 is affixed to each cylinder bank and has individual recesses 28 that form the combustion chambers. Spark plugs 29 are supported in the cylinder heads 27 and fire this charge in a known manner. When the charge has been fired and expanded, it is discharged through an exhaust port 31 to an exhaust manifold assembly 32 positioned in the valley between the cylinder banks 12.

The construction of the engine 11 as thus far described may be considered to be conventional insofar as the purposes of this application and, for that reason, further details of the construction are believed to be unnecessary to understand the operation of the invention and its construction.

Figure 3:
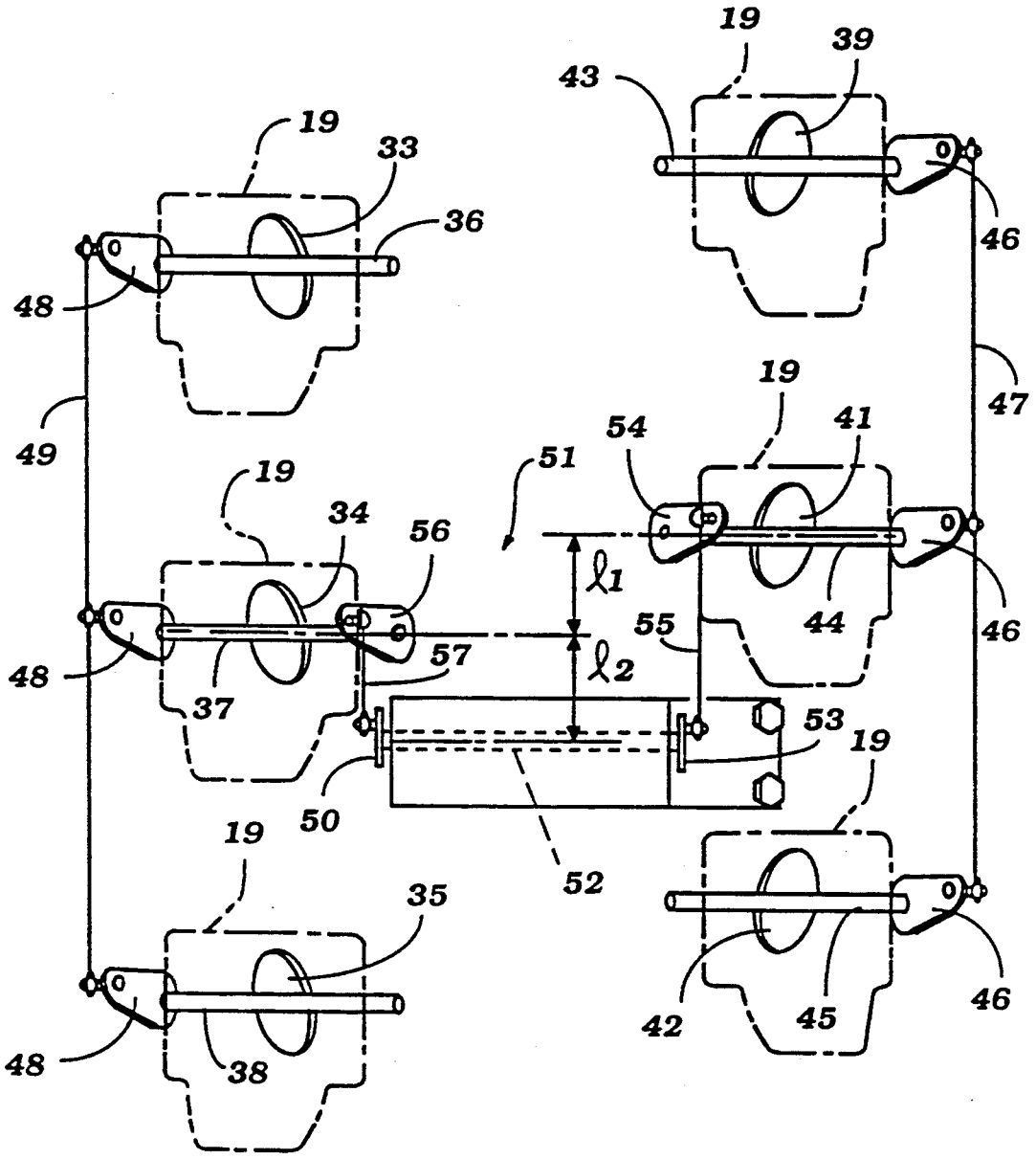
FIG. 3 is a partially schematic view looking generally in the same direction as FIG. 2, showing the carburetor throttle valves and synchronizing mechanism.

Referring now primarily to FIGS. 2 through 6 and primarily initially to FIG. 3, it will be noted that the carburetors 19 of one cylinder bank are provided with respective butterfly type throttle valves 33, 34 and 35 which are journaled in the carburetor bodies on respective throttle valve shafts 36, 37 and 38. The throttle valve shafts 36 through 38 extend perpendicularly to the induction passages of the carburetors 19 which may be either aligned or slightly offset to the respective cylinder bores of the served cylinder bank. Thus, the throttle valve shafts 36, 37 and 38 all are aligned in a vertical plane which plane is perpendicular to a plane defined by the centers of the induction passages.

In a similar manner, the carburetors 19 associated with the other cylinder bank have respective butterfly type throttle valves 39, 41 and 42 that are journaled for rotation within the bodies of these carburetors by throttle valve shafts 43, 44 and 45. The throttle valve shafts 43 through 45 define a common vertically extending plane that is disposed at an angle to the plane defined by the throttle valve shafts 36, 37 and 38 and which is perpendicular to the induction passages of the carburetors of the served bank. Also, because of the stagger of the cylinder banks, the throttle valve shafts 36, 37 and 38 lie on different horizontal planes than the throttle valve shafts 43, 44 and 45.

It is obviously desirable to synchronize the motion between all of the throttle valves 33, 34, 35, 39, 41 and 42 and this is made very difficult by the fact that the throttle valve shafts 36, 37 and 38 are non aligned with and non parallel to the throttle valve shafts 43, 44 and 45. This obviously gives rise to difficulties in providing a simple linkage system that will interconnect the throttle valves 33, 34, 35, 39, 41 and 42 for rotation in unison. However, since the throttle valves 33, 34 and 35 all rotate about parallel axes as do the throttle valves 39, 41 and 42, it is possible to interlink the throttle valves of the carburetors serving each cylinder bank with a common linkage system.

Such a linkage system comprises first levers 46 that are connected to each of the throttle valve shafts 43, 44 and 45 on the side outward from the V angle. A single link 47 interconnects all of these throttle valve shafts 43, 44 and 45. In a similar manner, a lever 48 is affixed to the outboard side of each of the throttle valve shafts 36, 37 and 38. These levers are all interconnected by a common link 49. Therefore, the throttle valves of the carburetors 19 associated with each of the cylinder banks 24 will be synchronized with each other.

In order to synchronize the throttle valve shafts of each cylinder bank with each other, there is provided an interlinking linkage system, indicated generally by the reference numeral 51. This linkage system includes an intermediate shaft 52 which, as viewed in a horizontal plane as seen in FIG. 1, extends between the inner ends of the shafts 37 and 44 although it is displaced from them as will be noted. Also, it should be noted that the angle between the shaft 52 and the shafts 44 and 37 is an obtuse angle which is greater than the angle between the shafts 44 and 37. As a result, the shaft 52 can be closer to alignment with the shafts 44 and 37 than these shafts are with are each other. This greatly facilitates synchronization and minimizes the likelihood of binding of the linkage system greater than the vertical distance between the individual throttle valve shafts 47 and 44 ($l_1$). The distance 1 is approximately equal to the offset between the cylinder banks, as aforenoted. Because of this relationship, it is possible to achieve a greater degree of synchronization and a lesser disparity of angular movement between the respective shafts.

A lever 53 is affixed to one end of the intermediate shaft 52 and a corresponding lever 54 is affixed to the corresponding end of the throttle valve shaft 44. Preferably the levers 53 and 54 should be of the same length. They can be made as the same piece. An interconnecting link 55 has a spherical connection at its lower end to the lever 53 and a spherical connection at its upper end to the lever 54. Hence, the rotation of the throttle valve shafts 36, 37 and 38 will all be transmitted to rotation of the intermediate shaft 52 or vice versa. It should be noted that if the throttle valve shaft 44 is rotated through an angle $\theta_1$, the intermediate shaft 52 will be rotated through an angle $\theta_2$. During this relative rotation, the link 55 will move through an arc $\alpha$. By maintaining the length $l_3$ of the link 55 as long as possible, it will be possible to minimize the difference in angular rotation between the throttle valve shafts $\theta_1$ and $\theta_2$ so as to minimize the phase lag $\theta_1$ minus $\theta_2$.

the intermediate shaft 52 is linked to the throttle valve shaft 37 by a first link 50 that is affixed to the end of the intermediate shaft 52 opposite the link 53. In a similar manner, a link 56 is affixed to the corresponding end of the throttle valve shaft 37. The links 50 and 56 are the same length as each other and may preferably be made as the same piece as each other and can be the same as the levers 53 and 54. Alternatively in some applications to aid in synchronizing one of the levers 53 or 56 may be made shorter than the others. In some other instances it may be desirable to make one of the levers 54 or 55 longer than the others. A link 57 has spherical connections at its opposite ends to the levers 50 and 56 so as to interrelate them for their movement When the intermediate shaft 52 rotates through the angle $\theta_2$, the throttle valve shaft 37 will rotate through an angle $\theta_3$. If the length of the link 57 ($l_4$) can be kept long the lag caused by relative angle or movement through the angle $\beta$ of the link 57 can be minimized so as to minimize the phase shift.

Figure 6:
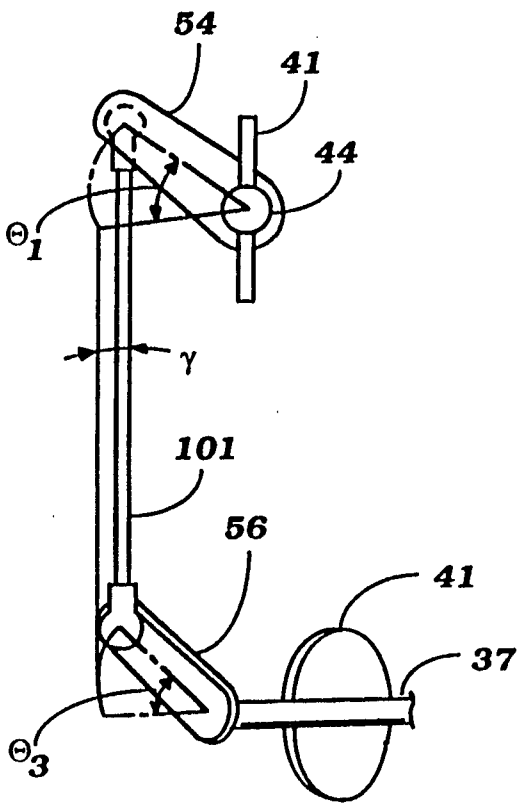
FIG. 6 is a schematic view, in part similar to FIGS. 4 and 5, showing how the shafts would be connected directly through a single connecting link and taken in the direction of one of the valve shafts.
Figure 5:
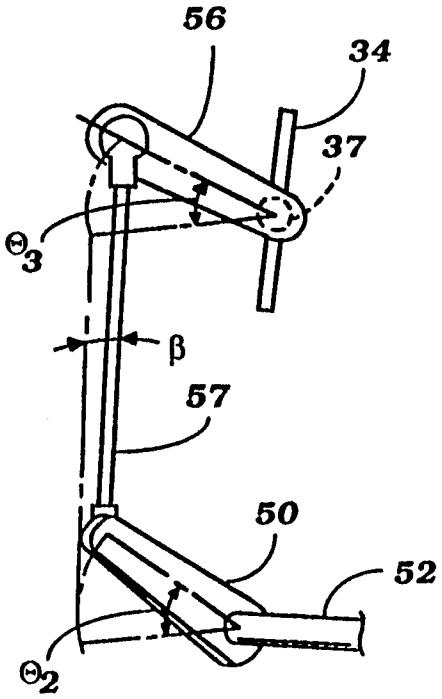
FIG. 5 is a view showing the interlinking system between the intermediate shaft and another one of the carburetors and is taken generally in the direction of the arrow 5 in FIG. 1.
Figure 4:
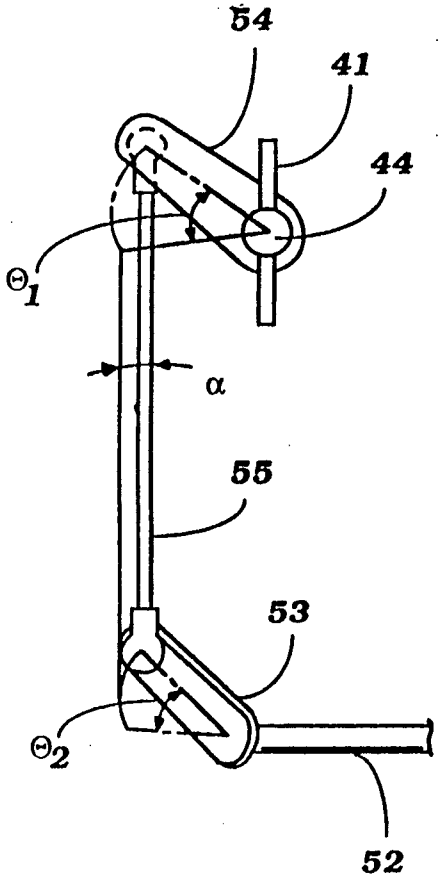
FIG. 4 is a view of the linkage system between the intermediate shaft and one of the carburetors and is taken generally in the direction of the arrow 4 in FIG. 1.

By the arrangement thus far described, it is possible to minimize the phase shift between the relative throttle valves by the use of the intermediate shaft 52. FIG. 6 shows the phase angle that would occur if the throttle valve shafts 44 and 37 were directly linked to each other by an intermediate link 101. It will be seen that this causes a greater angular movement $\gamma$ of the link 101 and thus would significantly change the phasing between the throttle valves 41 and 34.

A remote throttle control is connected in a known manner to any one of the throttle valve shafts 36, 37, 38, 44 or 45 or intermediate shaft 52 for engine speed control.

It should be readily apparent from the foregoing description that the described construction permits good synchronization of butterfly type valves that are associated with shafts that are non aligned and non parallel. In the illustrated and described embodiment, the butterfly valves were throttle valves of carburetors. It should be understood, of course, that the throttle valves can be those of intake trumpets of an injected engine rather than a carbureted engine. In addition, the valves so linked together could be choke valves of carburetors in addition to or in lieu of throttle valves.

It is to be understood that the foregoing description is that of preferred embodiments of the invention. Various changes and modifications may be made without departing from the spirit and scope of the invention, as defined by the appended claims.

I claim:

1. A valve arrangement for synchronizing the operation of first and second butterfly valves of first and second induction system controls, said first and said second butterfly valves being rotatable about a non parallel, non coincident first and second axes, an intermediate shaft rotatable about an axis, first and second levers affixed to opposite ends of said intermediate shaft, third and fourth levers affixed to one end of the said first and said second butterfly valves, and first and second links interconnecting said first and said third levers and said second and said fourth levers, respectively.

2. A valve arrangement as set forth in claim 1 wherein the first and second axes and the axis of rotation of the intermediate shaft all lie in parallel planes, the angle between the first and second axes projected into a common parallel plane being less than the angle between the intermediate shaft and the first and second axes.

3. A valve arrangement as set forth in claim 2 wherein the planes are spaced at different distances from each other.

4. A valve arrangement as set forth in claim 3 wherein the distance between the plane of the intermediate shaft and the planes of either of the first and second axes is greater than the distance between the planes of the first and second axes.

5. A valve arrangement as set forth in claim 4 wherein the induction passages with which the butterfly valves are associated are disposed at an angle to each other.

6. A valve arrangement as set forth in claim 5 wherein the intermediate shaft is disposed between the induction passages.

7. A valve arrangement as set forth in claim 1 wherein the axes are spaced at different distances from each other.

8. A valve arrangement as set forth in claim 7 wherein the distance between the axis of the intermediate shaft and the first and second axes is greater than the distance between the first and second axes.

9. A valve arrangement as set forth in claim 8 wherein the induction passages with which the butterfly valves are associated are disposed at an angle to each other.

10. A valve arrangement as set forth in claim 9 wherein the intermediate shaft is disposed between the induction passages.

11. A valve arrangement as set forth in claim 1 wherein the intermediate shaft is disposed between the induction passages.

12. A valve arrangement as set forth in claim 1 wherein there are further provided third and fourth butterfly valves rotatable about third and fourth axes for controlling the flow through third and fourth induction systems, the first and third axes lying in a common plane and the second and fourth axes lying in a common plane, and linkage means interconnecting the first and third butterfly valves and the second and fourth butterfly valves at ends opposite those to which the intermediate shaft is connected.

13. A valve arrangement as set forth in claim 12 wherein the first, second, third and fourth axes and the axis of rotation of the intermediate shaft all lie in parallel planes, the angle between the first and second axes projected into a common parallel plane being less than the angle between the intermediate shaft and the first and second axes.

14. A valve arrangement as set forth in claim 13 wherein the planes are spaced at different distances from each other.

15. A valve arrangement as set forth in claim 14 wherein the distance between the plane of the intermediate shaft and the planes of either of the first and second axes is greater than the distance between the planes of the first and second axes.

16. A valve arrangement as set forth in claim 15 wherein the induction passages with which the butterfly valves are associated are disposed at an angle to each other.

17. A valve arrangement as set forth in claim 16 wherein the intermediate shaft is disposed between the induction passages.

* * * * *